United States Patent [19]

Veith

[11] 4,144,911

[45] Mar. 20, 1979

[54] CONNECTOR COMPONENTS

[75] Inventor: Robert S. Veith, Marlboro, Mass.

[73] Assignee: Thomas Taylor and Sons, Inc., Hudson, Mass.

[21] Appl. No.: 851,436

[22] Filed: Nov. 14, 1977

Related U.S. Application Data

[63] Continuation of Ser. No. 702,968, Jul. 6, 1976, abandoned.

[51] Int. Cl.[2] ..... D03D 25/00; D21F 7/10

[52] U.S. Cl. ..... 139/383 A; 24/33 C; 28/141; 245/10

[58] Field of Search ..... 139/383 A, 383 R, 384 R, 139/385; 162/DIG. 1, 348, 349, 358; 245/10; 24/33 C; 28/141

[56] References Cited

U.S. PATENT DOCUMENTS

| | | | |
|---|---|---|---|
| 3,225,900 | 12/1965 | MacBean et al. | 139/383 A |
| 3,283,388 | 11/1966 | Kelleher et al. | 28/141 |
| 3,436,041 | 4/1969 | Haller | 245/10 |
| 3,546,330 | 12/1970 | Thompson | 24/33 C |
| 3,653,097 | 4/1972 | Kerber | 24/33 C |
| 4,006,760 | 2/1977 | Romanski et al. | 139/383 A |

FOREIGN PATENT DOCUMENTS

| | | | |
|---|---|---|---|
| 120949 | 6/1901 | Fed. Rep. of Germany | 139/383 R |
| 578519 | 7/1924 | France | 139/383 R |
| 1178897 | 12/1958 | France | 139/383 R |
| 1520478 | 3/1968 | France | 139/383 A |
| 40-2681 | 12/1965 | Japan | 162/DIG. 1 |
| 1072317 | 6/1967 | United Kingdom | 139/383 A |

*Primary Examiner*—James Kee Chi

*Attorney, Agent, or Firm*—Dike, Bronstein, Roberts, Cushman & Pfund

[57] ABSTRACT

Connector components for flexibly connecting and/or disconnecting parts herein specifically illustrated as connecting the ends of paper makers felts comprising spaced panels of concatenated crossing textile elements wherein the panels are connected at regularly spaced intervals longitudinally of the component by elements extending transversely of the panels across the gap therebetween, said components being foldable at the gap to provide substantially U-shaped loops such that the loops of two such folded components may be interengaged to receive a pintle element and said panels being adapted to be fixed to the parts to be flexibly connected.

4 Claims, 12 Drawing Figures

CONNECTOR COMPONENTS

This is a continuation, of application Ser. No. 702,968 filed July 6, 1976, now abandoned.

BACKGROUND OF THE INVENTION

Fabric connectors have certain advantages over metal connectors principally that they are not subject to corrosive destruction, are flexible which makes it possible to connect parts which are not perfectly aligned and will not transmit stresses and/or vibrations developed in one of the connected parts to the other. The non-corrosive property of such connectors is especially advantageous in connecting the ends of paper makers felts, conveyor belts and the like. However, they may be used to advantage in connecting prefabricated building panels, molded sections of synthetic resin, thin metals and the like where fastening elements such as screws, bolts, rivets and the like are undesirable. Connectors of this kind are commonly used to join the ends of paper markers felts as shown, for example, in U.S. Pat. Nos. 3,478,991; 3,283,388; 3,225,900; 3,224,516; 2,883,734 and 932,361. For use in connecting the ends of paper markers felts, the advantage of the all fabric connectors lies in the reduction of thickness of the seam and the elimination of marks on the paper as well as the advantage of resistance to corrosive destruction. Each of the aforesaid patents relies upon weaving a fabric in such a way as to provide the ends of the length of fabric with loops which can be interengaged to form a passage transversely of the felt for receiving a pintle. In Draper, for example, the fabric is a paper markers felt woven to provide loops at the terminal ends. In Schiel, a fabric sleeve is made from a length of fabric provided with loops at its ends which may be interengaged to provide a passage for receiving a pintle. In MacBean and the patents to Kelleher, connector components are shown provided with loops which may be interengaged to receive a pintle. While not disclosed by the patents referred to, it has been proposed to make a connector element by the simple expedient of extracting the warp elements from a piece of fabric to provide a gap which is crossed by filling elements and then fold the fabric symmetrically with respect to the center of the gap to provide a plurality of spaced U-shaped loops. Two such elements placed together with the loops interengaged will provide a continuous transverse passage for reception of a pintle. The connector elements in all of the patents mentioned lack strength and resistance to extension in tension. Further, since the twist in the filling elements tilts the loops all in the same direction, that is at an angle to the plane of the fabric, when two ends are brought together, it is difficult to interengage the loops, thus necessitating the need for jigs and other means for holding the loops parallel. It is the purpose of this invention to make a fabric connector which will not embody the disadvantages of prior all-fabric connectors and especially to provide a structure of vastly improved strength and resistance to extension in tension so that it will not stretch under operating conditions at sustained high temperatures and a structure which is resistant to abrasion, solvents, chemicals and the like, and finally to a connector structure which can be readily assembled.

SUMMARY OF INVENTION

As herein illustrated, the connector is comprised of two connector elements provided with interengageable loops along one edge adapted to be connected by a pintle element, each connector element comprising spaced groups of spaced parallel elements extending in one direction and spaced parallel elements extending across the elements extending in the one direction, said latter elements comprising at regularly spaced intervals longitudinally of said one direction crossing elements which extend from side to side across the gap between the groups of elements extending in the one direction and intermediate said crossing elements which extend from the edges to the gap, said crossing elements at opposite sides of the gap constituting panels and said crossing elements which extend from side to side constituting flexible links connecting said panels which are adapted to be formed into loops by folding of the panels at the gap. The elements crossing from side to side may be in single or multiple lengths and the elements crossing from the sides to the gap may be of single or multiple lengths. In a preferred form, the crossing elements are warp and filling elements wherein the warp elements are associated in groups to provide a gap longitudinally of the fabric and the filling elements are laid in such a way that alternately one lay comprises a filling element extending all the way across the fabric and back so as to traverse the gap in the warp elements and the same filling element and another filling element extend to the gap in the warp elements and back so as to provide a closed fabric structure of warp and filling elements at each side of the gap and a series of longitudinally spaced connecting links joining the closed fabric structures. In this preferred form, the warps are continuous multifilament yarn and the filling elements may be single or compound yarns. Within the gap, there may be one or more warp elements which constitute positioning means for centering the components for folding or finishing. In this preferred form, there are two ends, one of which is confined to the panel at one side of the gap and the other of which forms the connecting links between the panels. In another form, there are three ends in which one of the ends crosses the component from side to side and provides the connecting links between the panels. The other two are confined respectively to a panel at one side of the gap. The third form also comprises three ends wherein one end provides for multiple links connecting the panels and the other two ends are confined respectively to the panels at each side and form multiple lengths between the connecting links.

The warp and filling elements are man-made yarns chosen for resistance to the sustained high temperatures and the destructive effects of chemicals and solvents and the filling is especially chosen to be resistant to elongation in tension.

The invention will now be described in greater detail with reference to the accompanying drawings, wherein.

Figure 1:
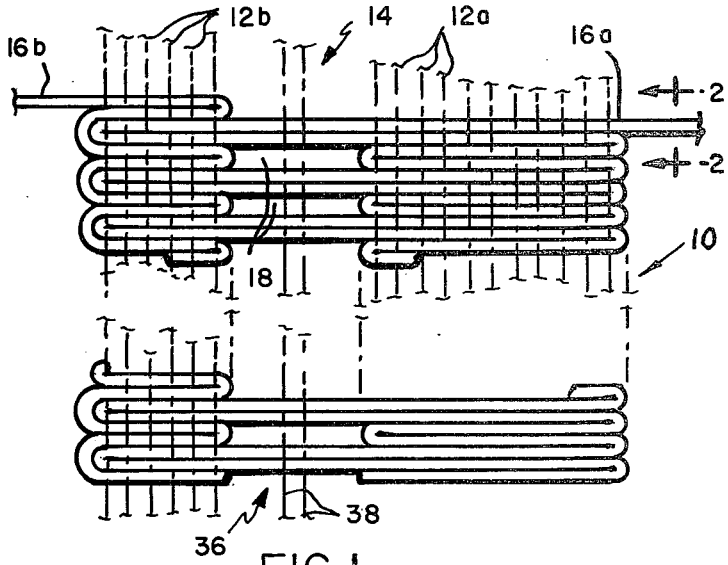
FIG. 1 is a plan view of a length of fabric made according to this invention.
Figure 4:
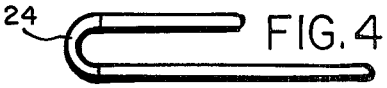
FIG. 4 is a section of a fabric after it has been folded on the center line of the gap.
Figure 5:
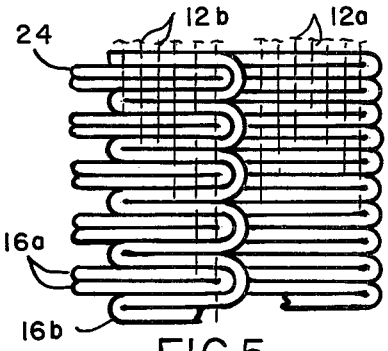
FIG. 5 is a plan view of FIG. 4 as seen from the top side of FIG. 4.
Figure 6:
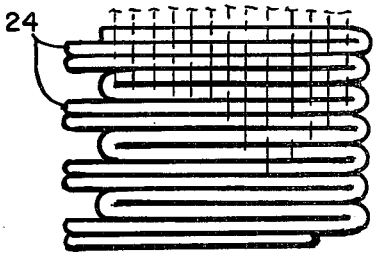
FIG. 6 is a plan view of FIG. 4 as seen from the bottom side of FIG. 4.
Figure 10:
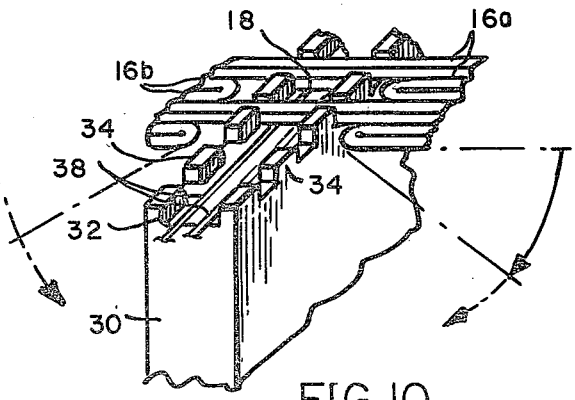
Figure 11:
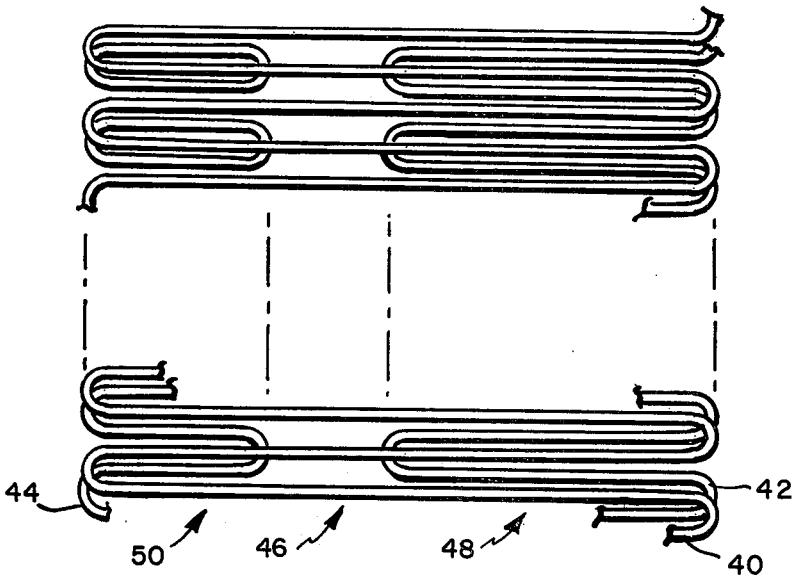
Figure 12:
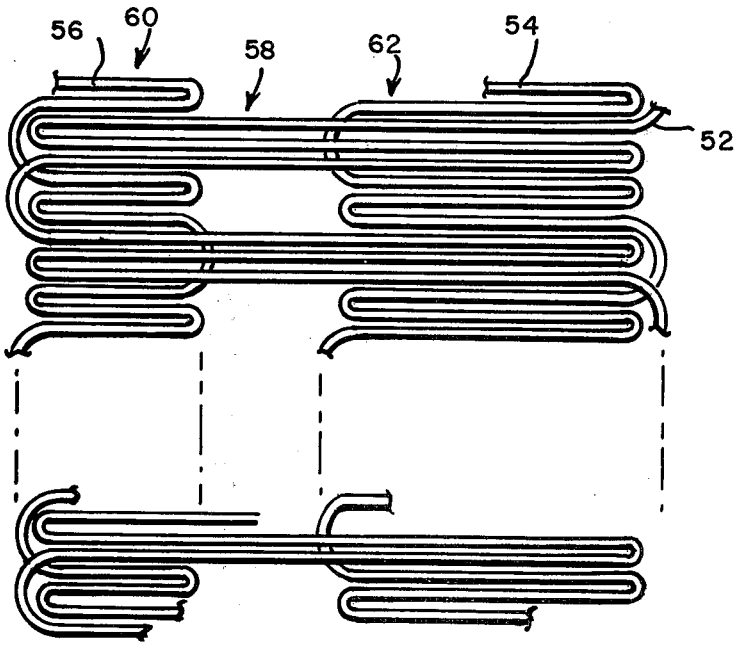

FIG. 10 diagrammatically illustrates folding the fabric shown in FIG. 1 to the U-shaped configuration shown in FIGS. 4, 5 and 6 in which the positioning means is used to hold the loops in properly spaced parallel relation for subsequent treatment in finishing the connector component;

FIG. 11 is a plan view diagrammatically illustrating an alternative form of connector elements provided with single connecting lengths between panels; and FIG. 12 is a third form wherein multiple connector lengths are provided between the panels.

Referring to the preferred form of the invention, FIGS. 1 to 10 inclusive, there is shown a length of fabric 10 of which the connector component is to be made (FIG. 1) comprised essentially of two groups of closely spaced parallel warp elements 12*a* and 12*b* between which there is a gap 14 and closely spaced parallel transversely extending filling elements 16*a* and 16*b*.

The warp elements 12*a* and 12*b* are comprised of continuous fiber filaments of synthetic material, for example, Nomex made by duPont, selected because of its high resistance to sustained heat, abrasion, hydrolysis and the deteriorating action of oils, lubricants, alkaline materials and/or solutions to which the elements may be exposed in use. Any equivalent yarn may be substituted therefor.

In the illustrated fabric, the warp elements are spaced at about 10 to the inch transversely of the fabric. However, it is within the scope of the invention to space the warp elements at whatever intervals are most economical and practical for the strength and thickness of the connector to be fabricated according to this invention.

The filling elements comprise longitudinally spaced pairs of filling elements 16*a* which traverse the warp elements from the right side all the way across to the left side and intermediate these spaced pairs of filling elements 16*b* at each side of the gap which extend from the sides to the gap, but do not cross the gap. This formation alternates throughout the length of the fabric so that at the gap there are longitudinally spaced pairs of closely parallel filling elements comprised of double lengths of the filling elements 16*a* between which there are spaces 18.

Figure 2:
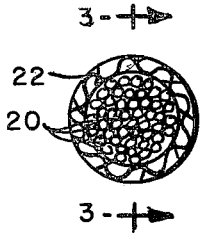
FIG. 2 is a diametrical section of a filling element taken on the line 2—2 of FIG. 1.
Figure 3:
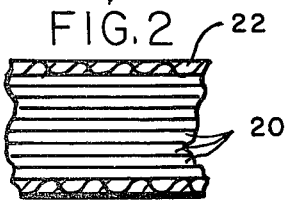
FIG. 3 is a longitudinal section of a filling element taken on the line 3—3 of FIG. 2.

The filling elements which are the elements which will be subjected to the major stresses when the connector components are attached to the parts to be joined thereby, desirably should embody high tensile strength and be substantially non-extensible under the most adverse conditions expected to be encountered. As herein illustrated, the filling elements are of compound construction comprising, as shown in FIG. 2, a core element 20 with a cover or sleeve 22. The core element is comprised of closely packed, uniformly straight, continuous fiber filaments associated in an untwisted parallel relation to the axis of the filling. Preferably, the fiber filaments employed herein are comprised of man-made fibers, for example, an aromatic polyamide such as Kelvar, a duPont product, and to obtain a maximum degree of strength from the fibers they are, as relatd above, laid parallel and uniformly straight. The Kevlar filaments are especially suitable for the purpose herein specifically illustrated since they have a very high tensile strength on the order of 22 grams per denier and sustain substantially no elongation under strss. To hold the fibers or filaments in the core in a bundle as a core, a cover or wrapper 22 is provided in one form as a braid. The braid may be comprised of continuous fiber elements of Nomex, also a polyamide, another duPont product, which is used because it is especially resistant to wear, heat, deterioration and the like, to protect the core. The cover or wrapper may be a wrapping of Nomex in place of braid, if desired, and in each case whether braid or wrapping, the yarn may be comprised of Nomex or an equivalent thereof. It is also within the scope of the invention to use a monofilament or multifilament of suitable strength with or without a coating, and if a coating is used, it may be applied by extrusion to the monofilament or multifilament.

Figure 8:
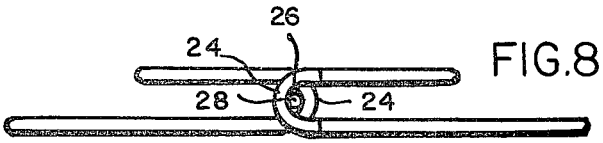
FIG. 8 is a section of two connector elements interengaged to provide a passage for receiving a pintle element.
Figure 9:
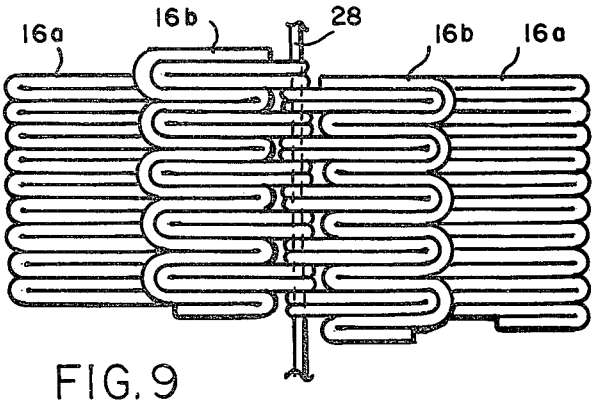
FIG. 9 is a plan view of the interengaged connector elements.
Figure 7:
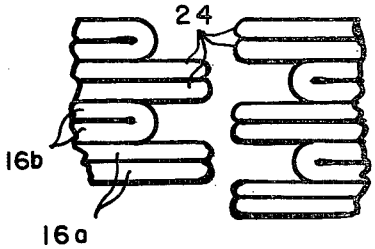
FIG. 7 is a plan view of the two connector components prior to interengagement of the loops showing the spacing of the connector elements.

When a length of fabric 10 has been concatenated as described above, it is folded at the longitudinal center line of the gap as illustrated in FIGS. 4, 5 and 6 so as to bend the doubled filling elements 16*a* to form U-shaped loops 24, FIGS. 4 and 7. Two such structures may be assembled together with the loops 24 in the two structures alternating as shown in FIGS. 8 and 9 to provide a substantially continuous passage 26 lengthwise for receiving a pintle element 28.

As shown in FIGS. 1, 5 and 6, one of the groups of warp elements is wider than the other. However, this is not critical since both groups may be made of equal width. The width of the gap may also be varied to suit the particular application.

After folding a length of fabric 10 on the longitudinal center line of the gap, it is customary to impregnate or coat the fabric with a stiffening material such as polyurethane so that the fabric retains its U-shaped form. One way of accomplishing this is diagrammatically illustrated in FIG. 10 wherein there is shown a jig 30 in the form of a rigid bar having along its upper edge a channel 32 on the opposite sides of which there are toothed ribs 34—34. The fabric is laid across the jig in a horizontal position as shown in full line so that the pairs of filling elements are depressed into the dents between the teeth, whereupon the portions of the fabric at opposite sides of the jig are folded down to the dotted line positions and the exposed surface of the folded down fabric is then brushed or sprayed with a stiffening material such as polyurethane. When dried, the structure is relatively rigid, but still flexible, and the loops 24 are fixed in uniform longitudinally spaced position relative to each other so that it is easy to introduce the loops of one element into those of the other without having to manipulate individual loops to so mesh them. As an assist in properly disposing the fabric on the jig and for positioning the loops thereon, it is desirable to include in the fabric 10 positioning means such as shown at 36, FIG. 1. The positioning means comprise one or more warp elements 38 situated between the two groups of warp yarns 12*a* and 12*b* comprised of any suitable yarn, for example, a polyester such as Dacron. The yarns 38 collectively provide means for holding the portions of the filling elements in the gap between the loops in uniformly spaced parallel relation throughout the length of the fabric and thus provide a dimensionally stable structure for ease in shipment and handling prior to and during folding and coating. The warp yarns 38 are designed to lie in the groove 32 between the teeth 34—34 at opposite sides of the jig and thus position the fabric on the jig for folding downwardly preparatory to coating. After coating has been applied and the folded fabric allowed to dry, the warp yarns 38 which are incorporated as a chain stitch can be readily removed by pulling at the free end which will unravel the entire lengths of the yarn from the fabric.

As an aid to assembling the connector components to interengage the loops, it is desirable to make the proposed connector components of contrasting colors. For example, one connector component may be made of a solid color wherein both the warp and filling elements are all one color, and the other may be made of two colors, for example, the warp elements of one color and the filling elements of another color.

In describing the fabric and its formation, the terms "warp" and "filling elements" have been employed because they generally describe the direction of the elements in the fabric, to wit, a fabric in which the warp elements run lengthwise of the fabric and the filling elements run transversely of the fabric, terms which are commonly used to describe the positions of the yarns in weaving. The positioning yarns 38 are incorporated in the fabric in the form of a chain stitch and after the folding and stiffening operations, may be easily removed.

An alternative structure is shown in FIG. 11 wherein the warp elements are omitted for the sake of clarity. There are three filling elements in this particular structure 40, 42 and 44. The filling element 40 extends continuously from side to side across the gap 46 between the spaced groups of warps 48 and 50 indicated diagrammatically by the dot and dash lines running the length of the fabric. The filling element 42 is confined solely to the right side of the component and the filling element 44 is confined to the left side, each being continuous so as to form in the concatenated structure, selvages at the opposite sides of the component and selvages at the opposite sides of the gap. In this form, the links between the panels formed by the concatenated warp and filling elements at opposite sides of the gap are comprised of longitudinally spaced single lengths of filling.

A connector component having multiple lengths of filling crossing the gap between the panels is shown in FIG. 12. In this structure, there are three ends 52, 54 and 56. The end 52 is continuous and travels back and forth from one side to the other across the gap 58 between the spaced groups of warp elements 60 and 62 indicated by the dot and dash lines running the length of the fabric so as to provide longitudinally spaced links comprised of three lengths of filling elements. The filling elements 54 are confined to the right side and the filling elements 56 to the left side and each of these is continuous so as to provide selvages at the outer sides and at the sides of the gap.

The several forms of connectors may be made on a knitting machine or a loom by appropriate control of the operation of such machines.

As previously stated, the connector elements of the several forms illustrated herein are designed to connect two parts desirably to be joined by fastening the panel portions of the components to the parts to be joined and then interengaging the loops and inserting a pintle element through the interengaged loops. The panels may be fastened to the parts to be joined by any appropriate means such as adhesive, or sewing or lacing.

It should be understood that the present disclosure is for the purpose of illustration only and includes all modifications or improvements which fall within the scope of the appended claims.

I claim:

1. A hinge element comprised of concatenated warp and filling elements woven in the flat, said elements comprising longitudinally-extending, transversely-spaced groups of closely-spaced warp yarns and two systems of transversely-extending, closely-spaced filling yarns, one system being confined to one group of warp yarns in an arrangement wherein double portions of the filling yarns are longitudinally-spaced by an amount corresponding to the thickness of the double portions which define a first panel and the other system comprising alternate and intermediate doubled portions which define a second panel, the alternate portions being confined to said other group at a longitudinal spacing corresponding to the thickness of the doubled portions and in transverse alignment with the double portions of the one side and the intermediate doubled portions being located between the alternate doubled portions of the other side and extending across from the other side to the one side between the doubled portions at the one side, said crossing portions connecting the panels, said doubled portions of the yarn, when woven into the warp yarns, being closely-spaced and said filling yarns crossing from one group of warp yarns to the other being longitudinally-spaced apart and supported in spaced relation to each other by the thickness of said double length of filling yarn.

2. A connector element comprising a fabric structured according to claim 1 folded to dispose the panels in spaced, parallel relation at a spacing to receive an end of the paper felt and to dispose the crossing portions in loops along one edge and means comprising a rigidifying material contained by the yarns of the fabric, fixing the panels in said spaced, parallel relation and the loops in spaced, parallel relation to each other and perpendicular to the planes of the panels.

3. A connector for paper making felt comprising two connector elements according to claim 2 adapted to be disposed with the loops of one alternating with the loops of the other to receive a pintle element for connecting the connector elements to each other.

4. A hinge element according to claim 1 wherein said filling elements are of high tensile strength, substantially inextensible and are comprised of a core of closely-packed, uniformly-straight fiber filaments associated in an untwisted, parallel relation and confined within a covering.

* * * * *